United States Patent [19]

Corsette

[11] 3,965,497

[45] June 29, 1976

[54] TOILET CHEMICAL DISPENSER

[76] Inventor: Douglas F. Corsette, 6559 Firebrand St., Los Angeles, Calif. 90045

[22] Filed: June 17, 1975

[21] Appl. No.: 587,640

[52] U.S. Cl. ..... 4/227; 4/228
[51] Int. Cl.[2] ..... E03D 9/02; E03D 9/03
[58] Field of Search ..... 4/222, 227, 228, 223; 222/56, 57, 67, 64, 546, 562, 563, 519, 541, 543

[56] References Cited

UNITED STATES PATENTS

| | | | |
|---|---|---|---|
| 2,839,763 | 6/1958 | Newsom | 4/227 |
| 3,698,021 | 10/1972 | Mack et al. | 4/227 |
| 3,766,570 | 10/1973 | Finneran | 4/222 |
| 3,778,850 | 12/1973 | Bryan | 4/228 |

*Primary Examiner*—Henry K. Artis
*Attorney, Agent, or Firm*—Richard E. Babcock, Jr.

[57] ABSTRACT

The discharge spout of an inverted container of liquid product to be dispensed is received in a sleeve, the upper end of which is threaded onto the container in outwardly spaced relation from the spout. A metering and sealing cup supported within the sleeve receives the spout, the arrangement being such that the sleeve may be rotated about its threaded connection to the container, either to bring the cup into sealing relation with the container spout or into dispensing relation with respect thereto. The cup normally maintains a supply of liquid above the level of the discharge opening of the spout lower end and, under proper pressure conditions, permits overflow of product through a discharge passage which establishes communication between the cup and the open lower end of the sleeve. The discharge is automatically controlled by alternate compression and decompression of air within the sleeve arising from rising and falling of the column of tank water therein, as the flush tank is flushed and refilled.

15 Claims, 8 Drawing Figures

TOILET CHEMICAL DISPENSER

This invention relates to improvements in a dispensing apparatus for delivering charges of a liquid product, such as an antiseptic and/or deodorant, directly into a toilet flush tank for ultimate reception in the toilet bowl, in response to rise and fall of the water level within the tank incident to flushing of the latter.

Important objects of the invention are to provide a simplified dispensing attachment preferably of unitary construction which, when associated with a conventional liquid product container, may cooperate selectively therewith to function either as an automatic dispenser for dispensing metered charges of the product into the flush tank, or as a shipping closure for the container.

A further object is to provide such a dispenser attachment which makes provision for adjusting the size of the metered charges of liquid product dispensed by it, such adjustment also rendering the attachment adjustable for optimum use at varying altitudes. Also, it is an object to provide such an attachment which may readily be removed and replaced to facilitate the filling and reuse of the container.

SUMMARY OF THE INVENTION

In order to achieve the foregoing objects as well as other incidental objects and advantages, the invention comprises, in combination with an enclosed liquid product container having a discharge spout directed downwardly therefrom, a dispensing closure or sleeve encircling and spaced from the spout and having an upper end connected to the container in substantially fluid tight manner for vertical adjustment relative to the spout. Supported within this sleeve beneath the spout is a metering and sealing cup which is movable vertically with the sleeve into and from sealing engagement with the spout. The cup includes an upstanding wall encircling and spaced from the lower end of the spout, so that the product within the cup will normally tend to act as a valve for controlling discharge from the spout.

The downwardly opening lower end of the sleeve projects below the cup and is adapted for communication with the water within a flush tank, so that the column of water which is caused to rise and fall within the sleeve, incident to filling and flushing of the tank, and the resulting variations in air pressure within the sleeve, will automatically actuate and control the dispensing operation. The cup communicates with the downwardly opening lower end of the sleeve through a passage which opens from the cup at a location above its bottom and is arranged to charge overflowing liquid product from the cup by gravity through the sleeve and into the tank.

Figure 1:
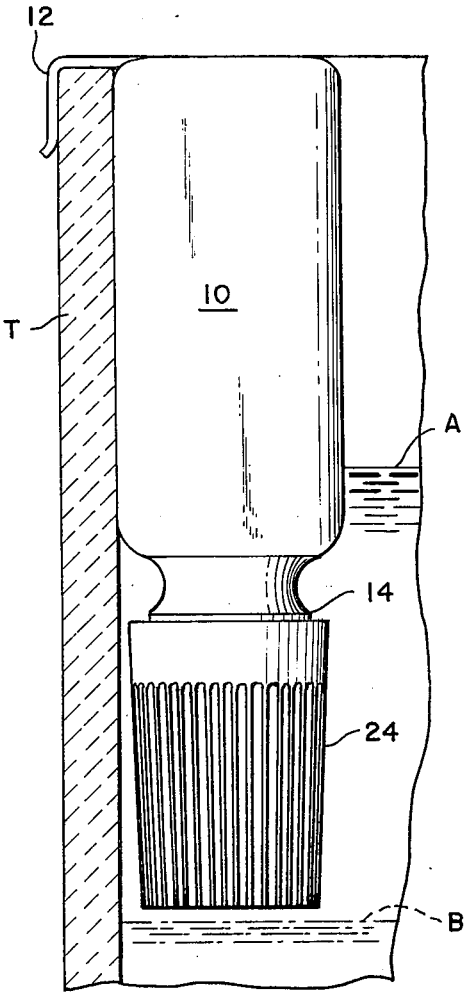
FIG. 1 represents a view through a portion of a flush tank, having the preferred embodiment of dispenser installed therein in accordance with the present invention.
Figure 2:
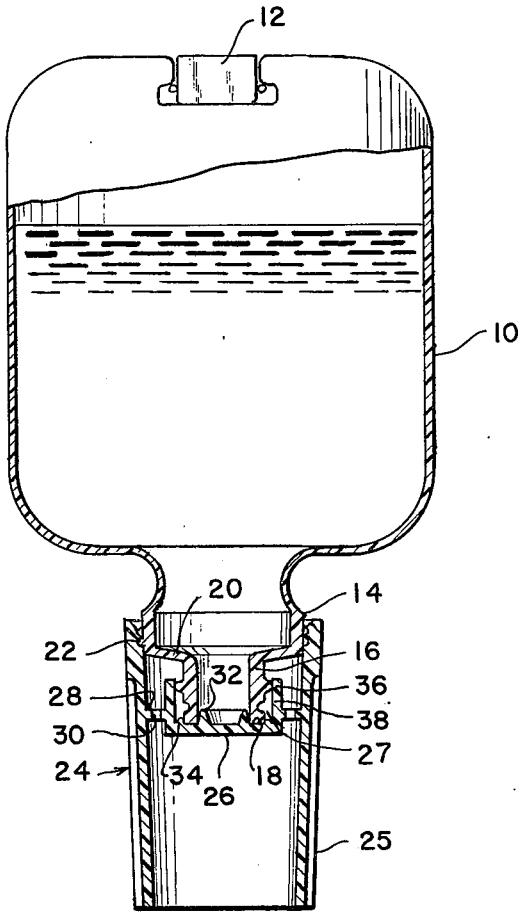
FIG. 2 is a sectional view on an enlarged scale of the dispenser per se, the same being in its closed or sealed position.
Figure 3:
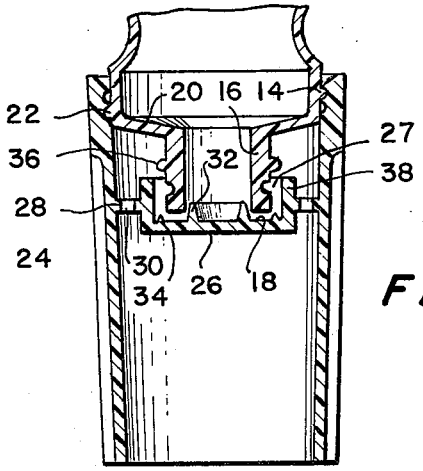
FIG. 3 is a fragmentary view on a still larger scale of the operative portion of the dispenser, showing the same in its open or dispensing position.

Referring now in detail to the accompanying drawings and considering first the preferred embodiment of the invention illustrated in FIGS. 1, 2 and 3, there is shown fragmentarily in FIG. 1, a portion of a conventional toilet flush tank T to which the invention is applied. It will be understood that the flush tank is of a well-known type in which water is supplied under the control of a float valve to fill the tank to a predetermined maximum level designated by the letter A. When the tank is flushed, the water is discharged into the toilet bowl (not shown) until it reaches a minimum level, such as designated by the letter B. Inasmuch as the various valves, conduits and actuating means for controlling the supply of water to the tank and its discharge, constitute no part of the present invention, but are quite well known in the art, these features are not illustrated in the drawings.

The numeral 10 designates any conventional container for the liquid chemical to be dispensed into the tank, it being understood that the chemical may comprise a suitable deodorant, cleaning agent and/or germicide in accordance with usual practice. The container 10 may conveniently comprise a usual plastic bottle of either rigid or slightly flexible construction. It will be noted the container is provided in conventional manner with a hook 12 which engages the upper edge of the tank to suspend the container 10 within the tank in inverted position with its generally cylindrical neck portion 14 directed downwardly.

In the instant embodiment, the neck 14 is illustrated as including a downwardly directed discharge spout 16, the annular lower end 18 of which defines the container mouth or outlet. The spout 16 thus is of smaller diameter than the neck portion 14 and is connected to the latter by an annular shoulder 20.

Threaded onto the neck 14, as at 22 is a sleeve 24, also preferably of a suitable plastic material. At or adjacent the threaded connection 22, the sleeve and container neck are sufficiently snugly associated as to prevent leakage therethrough of any substantial or material amount of air as the air pressure within the sleeve is altered by rise and fall of the water within the sleeve 24, incident to flushing and refilling of the tank T.

Figure 4:
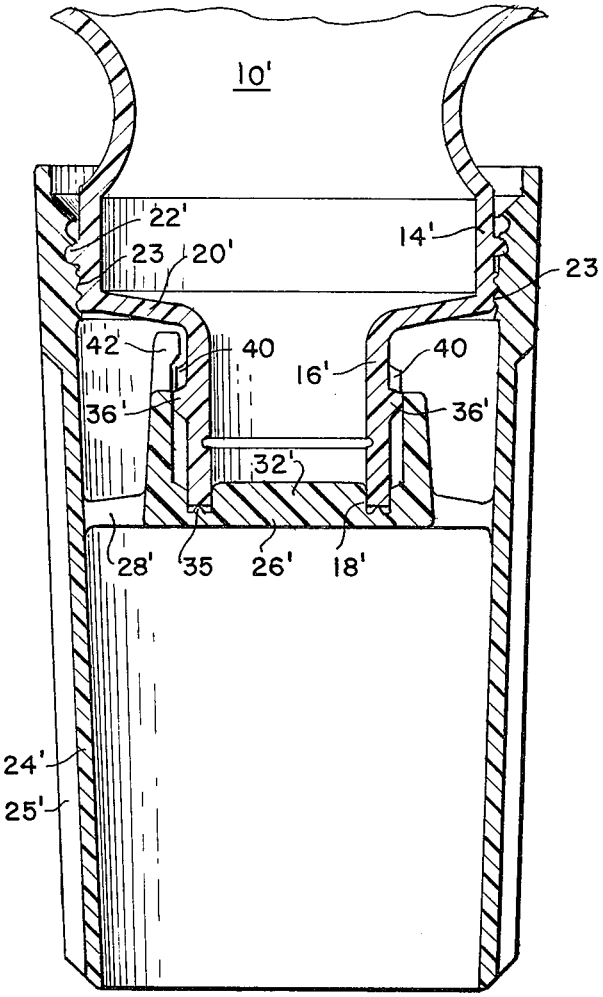
FIGS. 4 and 5 are generally similar sectional views of a modified form of the dispenser, showing the same respectively in its sealing position and its open or dispensing position.
Figure 5:
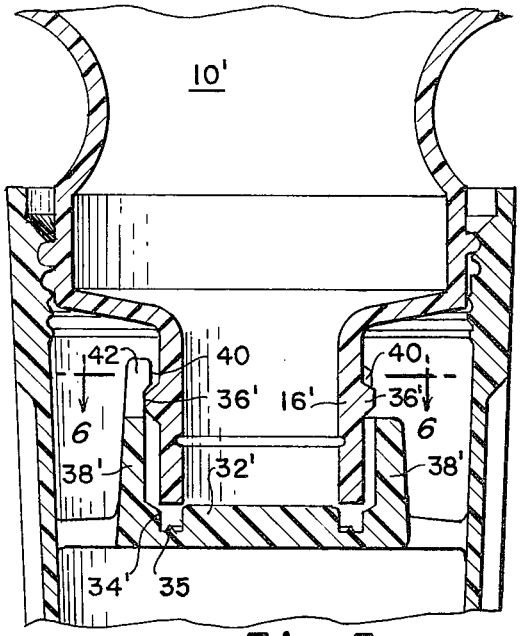

A product metering and sealing cup 26 is supported within and spaced from the inner periphery of the sleeve 24 in a suitable manner such as to permit communication between the cup and the lower open end of the sleeve. Means for thus supporting the cup may comprise an annular web 28 having one or more openings 30 therethrough between the cup 26 and the sleeve 24, as in FIGS. 2 and 3, or radial spokes 28′ as shown in FIGS. 4 and 5.

It will be noted that the cup 26 is aligned axially with the discharge end of the spout and that its upwardly directed annular wall or skirt 38 encircles the spout and is radially spaced therefrom to define an overflow chamber 27 so that when sleeve 24 is retracted to open position, as in FIG. 3, liquid product may flow downwardly through the spout 16 into the cup, thence (under the conditions hereinafter described) over the cup wall 38, and through the surrounding overflow chamber 27 and openings 30 into the lower end of the sleeve. The chamber 27 and openings 30 thus define a passage externally of the cup, between the cup and the open lower end of the sleeve.

As will be apparent, rotation of the sleeve 24 with respect to the bottle 10 will cause the threaded interconnection 22 to adjust the sleeve together with the cup 26, either to bring the cup into sealing relation with the container mouth 18 as shown in FIG. 2 or to bring it to an open dispensing position to permit egress of the container contents, as illustrated in FIG. 3.

The means for establishing and maintaining the sealed relation, as in FIG. 2, may assume any of various forms, well known to those skilled in the art. The sealing means herein illustrated are therefore to be regarded as merely exemplary in nature. Such means comprise inner and outer annular sealing ribs 32 and 34 respectively defining between them an annular groove with sloping sides, adapted for wedging sealing reception of the mouth defining end of the spout 16. In addition, the spout is encircled by a sealing bead 36 adapted for sealing engagement with the inner surface of the upwardly projecting skirt 38 of the metering cup 26, when the sleeve is fully threaded onto the container as in FIG. 2.

However in the open or dispensing position of the sleeve 24 of the container 10, as in FIG. 3, it will be seen that the end of the spout is withdrawn from engagement with the bottom of the cup 26, while the encircling rib 36 is fully withdrawn and disengaged from the wall or skirt 38 of the cup, all to the end that the interior of the container 10 is in communication with the interior of the sleeve 24.

It will be apparent from the above that the sleeve functions selectively as either a closure or as a dispensing device. In the operation of the invention, the container with the dispensing closure applied in sealed relation as in FIG. 2 is inverted and suspended by its hook 12 in the tank T. The dispenser sleeve 24 is rotated to bring it to the open position of FIG. 3, thus to permit liquid contents of the container 10 to fill the cup to a level at or somewhat above that of the container mouth 18 at which time, by preventing the entrance of air into the container mouth to replace the dispensed liquid, further outflow of liquid is prevented.

When the tank is flushed, the liquid level falls within the tank and within the sleeve 24, thus reducing the air pressure within the sleeve as well as in the cup 26, with a resulting outflow of further liquid from the container into the cup in an amount of overflow the cup to a predetermined extent.

When the water level within the tank drops below the lower edge of the skirt 24, atmospheric air is permitted to enter the skirt and terminate the relatively reduced or sub-atmospheric pressure therein, thus to terminate the outflow of liquid from the container. As will be readily apparent, this is due to the fact that a reduced pressure then prevails within the container above the fluid, while the liquid level within the cup, being above the mouth of the container prevents ingress of air into the container to replace the discharged liquid.

After water in the tank reaches its minimum level B and commences to rise upon the filling of the tank, the air entrapped within the sleeve by the rising water is compressed sufficiently to depress the fluid level within the cup 26, then to pass beneath the end 18 of the spout and bubble upwardly through the liquid contents of the container into the upper end of the inverted container, thus raising the pressure above the liquid within the container. With the air pressure thus raised or restored above the liquid, it will be seen that as soon as the pressure within the sleeve is reduced by subsequent flushing of the tank, a further metered supply of liquid from the tank will be caused to enter and overflow the cup 26 to be received within the tank water.

Manifestly, the amount of liquid thus discharged into the tank upon each flushing thereof may be adjusted by rotation of the sleeve 24 on the container, whereby action of the threaded interconnection 22, between the container and sleeve will vary the spacing between the discharge spout and the bottom of the cup 26 so that the latter will act as an adjustable metering valve.

Figure 6:
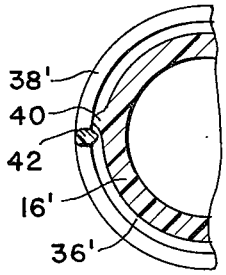
FIG. 6 is a section on the line 6—6 of FIG. 5.

In the modified embodiment illustrated in FIGS. 4, 5 and 6, the arrangement is substantially similar to that of the preceding figures, except that there are incorporated modified sealing means and also there is added an indexing means for facilitating the rotation of the sleeve 24' to any of various predetermined positions of adjustment, for thus adjusting the output of the dispenser.

In FIGS. 4, 5 and 6, parts corresponding to those of the embodiment of FIGS. 1, 2 and 3 are designated by similar but primed reference characters. In the modified embodiment of FIGS. 4, 5 and 6 the seal between the sleeve and the container neck is provided by one or more sealing ribs 23, formed on the inner cylindrical surface of the sleeve, below the threaded interconnection 22' for sealing engagement with the cylindrical exterior surface of the container neck. By this means air compressed within the sleeve by the rising water is prevented from escaping upwardly between the sleeve and the neck.

The seal between the end of the container spout 16' and the metering cup 26' is provided by a raised plug or stopper 32' on the upper surface of the cup bottom for sealing reception in the container spout. An annular sealing shoulder 34' concentrically surrounds the stopper 32' for sealing engagement with the cylindrical exterior surface of the spout. Additionally, on the bottom of the annular groove defined between the concentric elements 32' and 34' is an upwardly projecting annular sealing rib 35 for endwise sealing engagement with the end surface of the spout 16'.

A further auxiliary seal is provided by the sealing rib 36', as in the preceding embodiment.

Means for indexing the sleeve to any of one or more predetermined positions of rotation, so as to facilitate accurate selection of its rate of discharge, comprises one or more upwardly projecting axial ribs 40 on the outer surface of the spout projecting above the sealing rib 36' for engagement by one or more resilient detents 42, preferably formed integrally with the cup 26' and projecting upwardly from the skirt thereof.

The arrangement is such that in the sealing position of the sleeve on the container, as in FIG. 4, the protrusion or enlargement at the upper end of the detent is above and disengaged from the rib 40, but as the sleeve is rotated toward open position as in FIG. 5. its axial withdrawal from the container will open the cup 26' with respect to the discharge spout and bring the detent 42 into position for operative abutting engagement with a stop rib 40. This will sufficiently resist the continued rotation of the sleeve to enable the user to feel the resistance and discontinue the rotation in the proper position. However, if it is desired to continue rotation to bring the detent 42 to another rotational location on the container, the rotation may be continued with added force, thereby causing the somewhat resilient detent 42 to ride radially outwardly over the rib 40 and continue its rotary movement. To facilitate this overriding action, the detent 42 and rib 40 are preferably provided with appropriately inclined or sloping surfaces to achieve the outward camming action, all as is indicated in the fragmentary showing of FIG. 6, and the plastic or other material from which the sleeve is formed will have sufficient resiliency to permit the necessary flexing of the detent 42.

It is further to be noted that in FIGS. 4 and 5, the metering cup 26' is supported within the sleeve by spokes 28', rather than by the perforated annular web as in the preceding embodiment, although in either event, the arrangement is such as to provide free communication between the upper and lower portions of the sleeve interior on opposite sides of the support means 28', whatever its nature.

It will be readily apparent that the mode of operation of embodiment of FIGS. 4, 5 and 6 is similar to that described in connection with the preferred embodiment.

Figure 7:
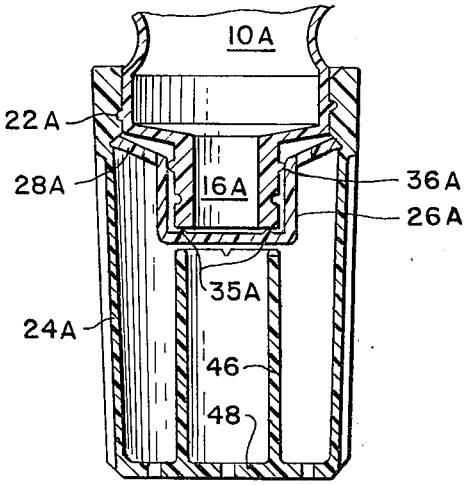
FIGS. 7 and 8 are similar sectional views of a still further modification of the invention, showing the same respectively in its sealing position and in its dispensing position.
Figure 8:
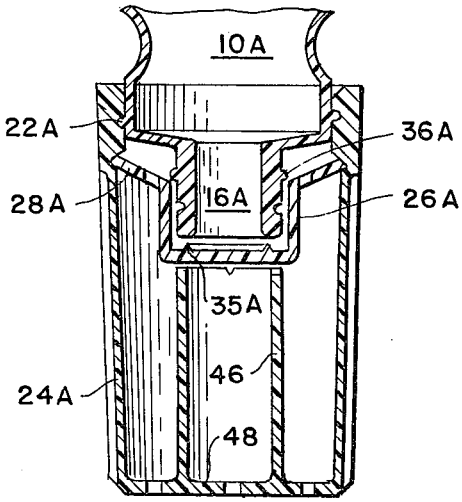

In FIGS. 7 and 8, there is shown a further modification of the invention in which parts corresponding to those of the preferred embodiment are designated by similar reference characters accompanied by the suffix A. The container 10A is, of course, similar in all material respects to the container of the preferred embodiment and has a threaded connection 22A to the sleeve 24A as in the preferred embodiment. However, the sleeve 24A is modified in such manner, that the metering cup or cap 26A is supported from its upper edge, rather than from its bottom, by the conical perforated web 28A. The metering cup in this instance is formed of a resiliently flexible plastic so that its web 28A might be temporarily deformed by insertion through the internally threaded upper end of the sleeve 24A, to thereafter expand so that its outer peripheral edge snap fits into a retaining groove in the sleeve. The encircling sealing rib 36A around the container spout 16A cooperates with the inner surface of the cup in the manner heretofore described. The seal between the bottom of the cup 26A and the lower end of the spout however is simplified to consist of simply the annular bead 35A on the bottom of the cup. In order to urge the cup bottom against the end of the spout, there is provided a tubular column 46 integral with and projecting upwardly from the perforated bottom 48 of the sleeve for endwise abutment with the cup bottom in the sealing position of the sleeve, whereby the cup bottom is compressed between the column 46 and the spout 16A.

The operation of this modification is substantially as in the preceding embodiments.

Having thus described my invention, I claim:

1. Dispensing apparatus for delivering charges of a liquid product into a toilet flush tank in response to the rise and fall of water level within the tank, comprising:

an enclosed liquid product container having a discharge spout directed downwardly therefrom;

a dispensing closure for said container comprising a sleeve encircling and spaced from said spout and having an upper end connected to said container in substantially fluid tight manner for vertical adjustment relative to said spout;

a metering and sealing cup supported within said sleeve, said cup being normally spaced beneath said spout for Vertical movement with said sleeve into sealing engagement with said spout and including an upstanding wall encircling and spaced from the lower end of said spout;

said sleeve having a downwardly opening lower end projecting below said cup for communication with the water within said tank;

said downwardly opening lower end being in communication with said cup through a passage extending externally of the cup and opening into said cup above the bottom thereof, for exposing the surface of the liquid product within the cup to the air pressure within the sleeve and for discharging overflowing liquid product from the cup by gravity into said tank.

2. Dispensing apparatus as defined in claim 1 wherein said upper end of the sleeve has a threaded connection to the container and is vertically adjustable relative to the spout by rotary movement of the sleeve relative to the container.

3. Dispensing apparatus as defined in claim 2 wherein said sleeve and said spout are generally cylindrical and in relatively spaced coaxial relation, said passage extending vertically between the cup and the sleeve.

4. Dispensing apparatus as defined in claim 3 wherein said cup includes an imperforate bottom normally spaced beneath said spout for vertical movement with said sleeve into sealing engagement with the spout.

5. Dispensing apparatus as defined in claim 4 wherein said cup includes an annular sealing rib on said bottom for sealing reception within said spout.

6. Dispensing apparatus as defined in claim 4 including concentric sealing ribs on said bottom for sealing reception between them of the lower end of said spout, said lower end of the spout also being of annular configuration.

7. Dispensing apparatus as defined in claim 4 including an annular rib on said spout for sealing engagement with said cup wall.

8. Dispensing apparatus as defined in claim 4 wherein said passage extends into said cup over the said upstanding wall.

9. Dispensing apparatus as defined in claim 5 including a plurality of relatively spaced spokes supporting said cup within the sleeve, said passage extending between said spokes.

10. Dispensing apparatus as defined in claim 3, wherein said cup includes an upstanding wall encircling and spaced from said spout, a radially projecting sealing rib encircling said spout at a level normally above said wall, but adapted for sealing engagement with the inner periphery of said wall in one position of vertical adjustment of said sleeve on the container.

11. Dispensing apparatus as defined in claim 10 including a radially projecting stop on said spout above said rib, and a positioning detent affixed to said cup and having an operative free end normally at a level above said stop, but adjustable by relatively rotary movement of the container and sleeve to a predetermined level for operative engagement with said stop.

12. Dispensing apparatus as defined in claim 11 wherein said detent is resiliently flexible and has an inclined surface for automatic overriding of said stop in response to the application of sufficient rotary force on said sleeve.

13. Dispensing apparatus as defined in claim 3, including an annular web extending radially outwardly from said cup wall and integrally connecting same to said sleeve, said passage extending through an opening in said annular web.

14. Dispensing apparatus as defined in claim 13, including a perforated web extending across the lower open end of said sleeve, and a supporting column projecting upwardly from said web for engagement with said cup to resist downward displacement of the latter when the sleeve is axially adjusted to urge said cup into sealing engagement with said spout.

15. Dispensing apparatus as defined in claim 3, including an annular web extending radially outwardly from said cup wall and connecting said wall to said sleeve, said passage extending through an opening in said annular web, there being a supporting column coaxially supported in said sleeve beneath said cup for engagement with said cup to resist axial displacement of the latter, when the sleeve is axially adjusted to urge said cup into sealing engagement with said spout.

* * * * *